US005504326A

United States Patent [19]

Reilly et al.

[11] Patent Number: 5,504,326

[45] Date of Patent: Apr. 2, 1996

[54] SPATIAL-VELOCITY CORRELATION FOCUSING IN TIME-OF-FLIGHT MASS SPECTROMETRY

[75] Inventors: James P. Reilly; Steven M. Colby; Timothy B. King, all of Bloomington, Ind.

[73] Assignee: Indiana University Foundation, Bloomington, Ind.

[21] Appl. No.: 327,618

[22] Filed: Oct. 24, 1994

[51] Int. Cl.[6] ..... H01J 49/40

[52] U.S. Cl. ..... 250/282; 250/287

[58] Field of Search ..... 250/282, 287, 250/281, 282, 286

[56] References Cited

U.S. PATENT DOCUMENTS

| | | | |
|---|---|---|---|
| 2,685,035 | 7/1954 | Wiley . | |
| 4,694,167 | 9/1987 | Payne et al. | 250/287 |
| 5,160,840 | 11/1992 | Vestal | 250/282 |

OTHER PUBLICATIONS

"Pulsed Ion Extraction Combined With High Accelerating Potentials For Matrix–Assisted Laser Desportion Time–of–Flight Mass Spectrometry", John J. Lennon and Robert S. Brown, from the 42nd ASMS Conference on Mass Spectrometry in Chicago, Illinois, Jun., 1994.

B. Spengler, et al., "Ultraviolet Laser Desorption/Ionization Mass Sepctrometry of Proteins above 100000 Daltons by Pulsed Ion Extraction Time–of–Flight Analysis", *Anal. Chem.*, vol. 62, No. 8, Apr. 1990, pp. 793–796.

V. I. Karataev, et al., "New Method for Focusing Ion Bunches in Time of Flight Mass Spectrometers", *Sov. Phys. Tech. Phys.*, vol. 16, No. 7, Jan. 1972, pp. 1177–1179.

B. A. Mamyrin, et al., "The mass–reflectron, a new non-magnetic time of flight mass spectrometer with high resolution", *Sov. Phys.–JETP.*, vol. 37, No. 1, Jul. 1973, pp. 45–48.

W. C. Wiley, et al., "Time–of–Flight Mass Spectrometer with Improved Resolution", *Rev. Sci. Instrum.*, vol. 26, No. 12, Dec. 1955, pp. 1150–1157.

R. J. Cotter, "Time–of–flight Mass Spectrometry: An Increasing Role in the Life Sciences", *Biomed. Environ. Mass Spectrom.*, vol. 18, 1989, pp. 513–532.

F. Hillenkamp et al., "Matrix–Assisted Laser Desorption/Ionization Mass Spectrometry of Biopolmers", *Anal. Chem.*, vol. 63, No. 24, Dec. 1991, pp. 1193–1203.

R. B. Opsal, et al., "Resolution in the Linear Time of Flight Mass Spectrometer", *Anal. Chem.*, vol. 57, No. 9, Aug. 1985, pp. 1884–1889.

M. Yang, et al., "A Reflectron Mass Sectrometer With UV Laser Induced Surface Ionization", *Int. J. Mass Spectrom. Ion Proc.*, vol. 75, 1987, pp. 209–219.

*Primary Examiner*—Jack I. Berman
*Assistant Examiner*—Kiet T. Nguyen
*Attorney, Agent, or Firm*—Woodard, Emhardt, Naughton, Moriarty & McNett

[57] ABSTRACT

An apparatus and method for minimizing ion peak width measurements in a time-of-flight mass spectrometer to thereby minimize the effects of initial ion position distributions and initial ion velocity distributions on the mass resolution of the spectrometer are provided. Where the ion source and ion generation geometries indicate a functional relationship between the initial ion position and initial ion velocity, this relationship is substituted into the time-of-flight equation and the instrument parameters are thereafter optimized to achieve minimization of ion peak width broadening. Experimental results using MALDI indicate reductions in ion peak widths of up to 96% over those observed with traditional MALDI techniques.

12 Claims, 10 Drawing Sheets

Relative Intensity
100
90
80
70
60
50
40
30
20
10
0
300
302
9.0
9.2
9.4
9.6
9.8
10.0
10.2
10.4
10.6
10.8
11.0
Time of Flight (microseconds)

Relative Intensity
300
250
200
150
100
50
0
304
306
12.5
12.7
12.9
13.1
13.3
13.5
13.7
13.9
14.1
14.3
14.5
Time of Flight (microseconds)

Relative Intensity
5000
4000
3000
2000
1000
0
308
310
13.4 13.6 13.8 14.0 14.2 14.4 14.6 14.8 15.0 15.2
Time of Flight (microseconds)

Relative Intensity
2200
2000
1800
1600
1400
1200
1000
800
600
400
200
0
312
314
17.5 17.7 17.9 18.1 18.3 18.5 18.7 18.9 19.1 19.3 19.5
Time of Flight (microseconds)

Relative Intensity
100
90
80
70
60
50
40
30
20
10
0
400
402
24.0 24.2 24.4 24.6 24.8 25.0 25.2 25.4 25.6 25.8 26.0 26.2
Time of Flight (microseconds)

Relative Intensity
110
100
90
80
70
60
50
40
30
20
10
0
404
406
39.4 39.6 39.8 40.0 40.2 40.4 40.6 40.8 41.0 41.2 41.4 41.6
Time of Flight (microseconds)

Relative Intensity
800
700
600
500
400
300
200
100
0
408
410
40.0 40.2 40.4 40.6 40.8 41.0 41.2 41.4 41.6 41.8 42.0 42.2
Time of Flight (microseconds)

Relative Intensity
500
400
300
200
100
0
412
414
46.6 46.8 47.0 47.2 47.4 47.6 47.8 48.0 48.2 48.4 48.6 48.8
Time of Flight (microseconds)

SPATIAL-VELOCITY CORRELATION FOCUSING IN TIME-OF-FLIGHT MASS SPECTROMETRY

FIELD OF THE INVENTION

The present invention relates to instrumentation for providing molecular mass spectral information using time-of-flight measurement methods, and more specifically to an apparatus and method for improving the resolution of such instrumentation by simultaneously reducing the effect of both the initial spacial and initial velocity distributions of the ionized molecules.

BACKGROUND OF THE INVENTION

Instrumentation for performing time-of-flight (TOF) mass spectral analysis to determine the mass of an ionized molecule has been known for several decades. By measuring the velocity (v) of an ion having a known kinetic energy (KE), its mass (Ill) can be determined via the well known relationship:

$$KE = \frac{mv^2}{2} \quad (1)$$

A typical two-step linear time-of-flight mass spectrometer 10 (TOFMS) shown in FIG. 1 has three distinct regions. For gas phase sample sources, the gas circulates within region 1 of width $d_1$ located between grids (or plates) $G_0$ 12 and $G_1$ 16. Within region 1, ions 24 and 26 are produced from the sample using, for example, an electron beam or a laser. Ions 24 and 26 are ideally formed at a position $X_0$ and then accelerated to the same kinetic energy by electric fields $E_1$, generated within region 1, and $E_2$, generated within region 2, where region 2 is of width $d_2$ and is located between grids (or plates) $G_1$ 16 and $G_2$18. Electric field $E_1$ is achieved in the direction shown in FIG. 1 to accelerate positively charged ions by applying appropriate voltage potentials to the grids (or plates) $G_0$ 12 and $G_1$ 16. Similarly, electric field $E_2$ is achieved in the direction shown to accelerate positively charged ions by applying appropriate voltage potentials to the grids (or plates) $G_1$ 16 and $G_2$ 18. It should be noted that electric fields $E_1$ and $E_2$ may be reversed in direction, by applying voltage potentials of appropriate magnitudes to grids (or plates) $G_0$ 12, $G_1$ 16 and $G_2$ 18, to accelerate negatively charged ions to the same kinetic energy in the direction shown in FIG. 1.

Within the field free drift region 20 of length L, ions with different mass to charge ratios separate in space and time. For example, if ion 24 has mass $m_1$ and ion 26 has mass $m_2$, where $m_2$ is greater than $m_1$, then ion 24 will reach the end 22 of the drift region 20 before ion 26. A detector 28 is typically located at the end 22 of the drift region 20 for recording the arrival of ions as a function of time. Thus, the difference between the start time, common to all ions generated within region 1, and the arrival time, at the detector 28, of a packet of ions having the same mass is a function of their mass to charge ratio (m/z), and can therefore be used to calculate the mass of the ions.

If an ion's flight time was strictly dependent upon its mass-to-charge ratio, the TOFMS 10 (or any other TOFMS instrument) would have unlimited resolution. In practice, however, an ion's time-of-flight additionally depends upon space charge effects, inhomogeneous electric fields, the finite frequency response of the detector 28 and associated signal processing electronics, the temporal spread of the ionization source, the initial distribution of ion velocities and the spatial spread of ions within tile source region (region 1). These additional dependencies combine to decrease resolution in the TOFMS 10 by increasing the measured time width of the ion packet that reaches the detector 28.

Space charge effects are manifest in an increased velocity spread due to coulombic repulsions or attractions between ions and can be reduced by using low power lasers or sample pressures. Careful design and construction of the acceleration grids $G_0$–$G_2$ reduces the effects of fringing fields, grid deformation and electric field punching through the grids. Using high-frequency pulse counting techniques can extend the resolution of the detection/signal processing electronics into the picosecond regime and state-of-the-art picosecond laser sources can virtually eliminate the temporal spread of the laser ionization source as a significant factor in ion peak width. Thus, under normal operating conditions, resolution in the TOFMS 10 is dominated by the initial velocity and spatial distributions.

In order to facilitate an understanding of the effects of the initial velocity and spatial distributions on TOFMS 10 resolution, and of prior attempts at reducing these effects, reference is made to FIGS. 2–5. The structural features of the linear TOFMS 10 in FIGS. 2–5 are identical to that of FIG. 1 and the same reference characters are therefore used in the description of these FIGS.

In FIG. 2, an example is shown where two ions 30 and 32 have identical masses (as shown by tile relative sizes of dots 30 and 32) and initial velocities (as shown by the magnitude of the arrows extending therefrom), but were displaced in space at ionization. Specifically, ion 30 began its acceleration toward the end 22 of tile drift region 20 at a distance $X_{0,1}$ from grid $G_0$ 12 and ion 32 began at a distance $X_{0,2}$ from grid $G_0$ 12. This difference in starting positions affects the flight of the ions 30 and 32 in two ways. First, since ion 30 travels a shorter distance through the electric field $E_1$, it receives less of a boost in kinetic energy (KE) due to electric field acceleration than does ion 32. In view of equation (1), ion 30 will therefore have less velocity than ion 32 upon arrival at grid $G_1$ 16. Second, due to the starting positions $X_{0,1}$ and $X_{0,2}$, ion 32 has a greater total distance to travel than does ion 30. Both velocity and total distance traveled therefore influence the time of flight of each ion. Thus, although ions 30 and 32 have identical masses and ideally should therefore reach the end 22 of the drift region 20 simultaneously, a finite time differential may exist between their detection by detector 28 (not shown in FIG. 2), thereby increasing the measured time width (and decreasing resolution in the TOFMS 10) of this particular ion signal.

In FIG. 3, an example is shown where two ions 34 and 36 have identical masses and begin their acceleration toward the end 22 of the drift region 20 at the same distance $X_0$ from grid $G_0$ 12, but have different initial velocities as shown by the magnitudes of the arrows extending therefrom. Since both ions 34 and 36 experience the same acceleration in electric fields $E_1$ and $E_2$, the total velocity of ion 36 will always be greater than that of ion 34 and it will therefore reach the end 22 of the drift region 20 before ion 34. As with the initial spatial differential example shown in FIG. 2, a difference in total velocity between ions 34 and 36, in this case due to different initial velocities, results in a variation in measured time of flight, and decreased TOFMS 10 resolution, of this particular ion signal.

In the TOFMS 10 of FIGS. 1–3, ions are formed from a gas phase sample circulating within region 1, typically by electron impact ionization or laser induced ionization. Ions so formed have a spatial distribution that is independent of their velocity distribution. In contrast, ions can also be produced in the source region (region 1) of TOFMS 10 from involatile molecules, i.e., those that remain on a surface until being desorbed into the gas phase by laser irradiation, particle bombardment or similar means. Desorption may produce neutral molecules (neutrals) for later ionization in the gas phase, and/or may produce gas phase ions directly from the sample surface. The instant of time $t_0$ at which either desorbed neutrals are converted into ions in an electric field or, alternatively, the instant of time at which desorbed ions are accelerated toward a detector by a pulsed electric field (hereinafter referred to as an ion drawout electric field), provides the starting point for measuring ion flight times to the detector. In either case, the spatial and velocity distributions of ions at $t_0$ are referred to as the initial spatial and velocity distributions. Following the drawout of ions by either technique, ion flight through a TOFMS, such as TOFMS 10, occurs in the same manner as described with respect to FIG. 1.

Referring now to FIG. 4, a sample 14 is deposited onto grid (or plate) $G_0$ 12 of TOFMS 10 for desorption of ions therefrom. With this approach, initial ion velocity distribution is a principal contributor to mass spectral peak broadening. When ions are desorbed/ionized from such a sample 14, their velocity distribution, as shown by arrows 38 and 40, is typically wider than those observed with gas phase samples. This is because of the energy required to induce the desportion, and results in further broadening of the mass spectral peaks and corresponding reduction in TOFMS 10 resolution.

Over the past several decades, many techniques have been developed to increase mass resolution in the TOFMS by compensating for the initial variations in ion velocity and position. Two noteworthy examples are the space focusing technique disclosed in U.S. Pat. No. 2,685,035 to Wiley and in *Time-of-Flight Mass Spectrometer with Improved Resolution*, Wiley, W. C. and McLaren, I. H., Rev. Sci. Instr. 26, 1150 (1955), and the development of a reflectron TOFMS as disclosed in *The Mass-Reflector, A New Nonmagnetic Time-of-Flight Mass Spectrometer With High Resolution*, Mamyrin, B. A., Karataev, V. I., Shmikk, D. V. and Zagulin, V. A., Sov. Phys. JETP 37, 45 (1973).

Using the space focusing technique, an equation for total ion flight time is derived. The time of flight (TOF) is a function of the ion's mass to charge ratio (m/z), initial position ($X_0$) and initial velocity ($v_0$), the total distances of the various regions in the TOFMS ($D_x$) and the strengths of the various electric fields established within the TOFMS ($E_x$). In other words, $$TOF=f(m/z, X_0, v_0, D_x, E_x) \quad (2)$$

The partial derivative of equation (2) is taken with respect to $X_0$, set equal to zero and solved for $E_x$. This technique results in finding a set of grid voltages that establish the necessary electric fields for minimizing the effect of the initial variations in ion position. Although the corollary "velocity focusing" cannot be implemented (i.e., a set of practical electric fields that yield the result $\partial TOF/\partial v_0 = 0$ cannot be found), Wiley and McLaren further attempted to correct for the initial velocity distribution by providing a time delay between the formation and acceleration of the ions (called time lag focusing). They noted, however, that their initial spatial and velocity distributions are independent, and that time lag focusing necessarily violates space focusing conditions. Thus, depending on which distribution contributes more to mass spectral peak broadening, they concluded that time lag focusing may improve spectrometer resolution in some cases, but in other cases it will have a defocusing effect.

In the reflectron TOFMS, an ion mirror is placed in the flight path of the ion packets. If the mirror electrode voltages are arranged appropriately, the peak width contribution from the initial velocity distribution can be significantly reduced at the plane of the detector. In operation, the structural arrangement of the reflectron TOFMS requires ions produced with large velocities to travel greater distances than their slower counterparts, leading to narrowed temporal profiles at the detector. Such an instrument, however, is significantly more complicated than a linear TOFMS and still suffers from the initial ion spatial distribution discussed above.

In recent years, the formation of ions within a typical TOFMS has been routinely accomplished by direct desorption from a sample surface as previously discussed. Lasers ranging in wavelength from the far-UV to the far-IR have been used with a variety of organic and inorganic materials to generate ions for analysis by mass spectrometry, leading to the development and commercial availability of the laser microprobe mass analyzer (LAMMA) and the laser ionization mass analyzer (LIMA). Although widespread in use, these instruments were somewhat limited. Only atoms or molecules below a particular size could be desorbed either as intact ions or as intact neutrals that could be subsequently ionized in the gas phase. In the last few years, however, the ability to produce gas phase ions of large biomolecules and polymers was developed using a technique known as matrix-assisted laser desorption/ionization (MALDI). In addition to laser desorption, other ion formation techniques are known, such as fast atom bombardment (FAB), plasma desorption (PD) and the desorption of secondary ions from surfaces using primary ions in the keV energy region. The latter has led to the development of the secondary ion mass spectrometer (SIMS).

The recent popularity of MALDI has led to the modification of TOFMS 10 shown in FIG. 5. Since mass spectral peak broadening is believed to be dominated by the initial ion velocity distribution in desorption/ionization techniques, researchers have attempted to reduce its effect by using high ion drift energies. In what will hereinafter be referred to as the "traditional MALDI technique", ions generated within region 1 are accelerated to high velocities (to reduce the effect of initial ion velocity distribution on total velocity within the drift region) and then allowed to travel through the drift region 20 of increased length to a detector 110 located at the end 22 of the drift region 20. Thus, although "velocity focusing" per se cannot be performed, tile effects of initial ion velocity distribution on mass spectral peak broadening can be reduced by using high drift velocities. This approach requires only a single acceleration region. A schematic of such an instrument 11 is shown in FIG. 5 wherein $G_2$ 18 of TOFMS 10 in FIG. 4 has been removed and the drift region 20' is extended to length L'.

Regardless of the ion formation method, each of the foregoing techniques and instruments is used with time-of-flight analysis in generating mass spectra. Thus, all suffer from tile resolution limiting factors discussed above. Therefore, what is needed is a simple and effective technique for either eliminating or drastically reducing tile effects of these distributions in a linear TOFMS in order to to increase mass spectral resolution in such an instrument.

SUMMARY OF THE INVENTION

The present invention provides a solution to the foregoing problems and shortcomings of the prior art techniques for increasing the mass resolution of a time-of-flight mass spectrometer.

According to one aspect of the present invention, a method of spatial-velocity correlation focusing in a time-of-flight mass spectrometer to minimize the effects of distributions in initial ion position and initial ion velocity on the ion mass resolution of the spectrometer is provided. The spectrometer has a first region for applying an ion accelerating field to accelerate ions of various mass to charge ratios generated from a sample source disposed within the first region and an ion detector remote from the first region. The method comprises the steps of (1) determining a first equation for the time-of-flight of tile ions generated within the first region to tile detector. The first equation depends upon the internal geometry of the spectrometer and is a function of a set of spectrometer variables including ion acceleration field strengths, distance between the generated ions and the detector, ion mass, initial position of the ions generated within the first region, initial velocity of the ions generated within the first region and the time delay between the generation of ions within the first region and application of the acceleration field for accelerating the ions toward the detector, (2) determining a second equation relating initial ion position within the first region to initial ion velocity within tile first region. The second equation depends upon the location of the sample source within the first region and is a function of the ion generation geometry, (3) substituting the second equation into the first equation to form a third equation for the time-of-flight of ions from the first region of the spectrometer to the detector. The third equation eliminates one of the initial ion position and the initial ion velocity as a variable thereof, and (4) determining the optimum set of variables from the third equation so that the time spread in the time-of-flight of generated ions of any particular mass to charge ratio to the detector is minimized, wherein minimizing the time spread in the time-of-flight of the generated ions to the detector of any particular mass to charge ratios results in minimizing the effects of both the initial ion position distribution and initial ion velocity distribution on the ion mass resolution of the spectrometer.

According to another aspect of the present invention, a time-of-flight mass spectrometer (TOFMS) for minimizing the effect on the TOFMS mass resolution of distributions in initial position and initial velocity of ions generated within the spectrometer is provided. The TOFMS comprises a first grid connected to a first potential source for applying a first potential thereto, a second grid juxtaposed with the first grid, the first and second grids defining a first region therebetween, the second grid being connected to a second potential source for applying a second potential thereto, a sample source disposed within the first region for generating ions of various mass to charge ratios therefrom into the first region when the sample source is excited by external means, wherein the ions have an initial position distribution and an initial velocity distribution within the first region, and the initial position of each of the ions is a function of the initial velocity of the respective ion, and means for detecting the ions generated within the first region, the means for detecting being disposed remote from the second grid. The first and second potentials are applied to the first and second grids respectively at a predetermined time after the ions are generated within the first region to establish a first electric field of appropriate direction for accelerating the ions toward the means for detecting. The relative strengths of the first and second potentials and the predetermined time at which they are applied to the grids are chosen so that the time spread in the time of flight of ions of any particular mass to charge ratio generated within the first region to the means for detecting is minimized, thereby simultaneously minimizing the effect on the TOFMS mass resolution of the distributions in initial position and initial velocity of the ions generated within the first region.

According to a further aspect of the present invention, a system for minimizing the effect of distributions in initial ion position and initial velocity on the mass resolution of a time-of-flight mass spectrometer (TOFMS) is provided. The system comprises a TOFMS having a sample source disposed within a sample region and an ion detector disposed a predetermined distance from the sample source, means for generating ions of various mass to charge ratios from the sample source, wherein the generated ions have an initial position distribution and an initial velocity distribution within the sample region, and the initial position of each of the ions generated within the sample region is a function of the initial velocity of the respective ion, means for establishing an electric field within the sample region of the TOFMS, the electric field accelerating the generated ions toward the ion detector, and means responsive to the ion generating means for triggering the electric field establishing means to establish the electric field a predetermined time after generating the ions. The strength of the electric field and the predetermined time period are chosen so that the time spread in the time of flight of generated ions of any particular mass to charge ratio to the means for detecting is minimized, thereby simultaneously minimizing the effect on the TOFMS mass resolution of the distributions in initial position and initial velocity of the generated ions.

It is one object of the present invention to provide a method for simultaneously minimizing the effect of initial ion spatial distributions and initial ion velocity distributions on the mass resolution of a time-of-flight mass spectrometer.

It is another object of the present invention to provide a system for simultaneously minimizing the effect of initial ion spatial distributions and initial ion velocity distributions on the mass resolution of a time-of-flight mass spectrometer.

These and other objects of the present invention will become more apparent from the following description of the preferred embodiment.

DESCRIPTION OF THE PREFERRED EMBODIMENT

For the purposes of promoting an understanding of the principles of the invention, reference will now be made to the embodiment illustrated in tile drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 6:
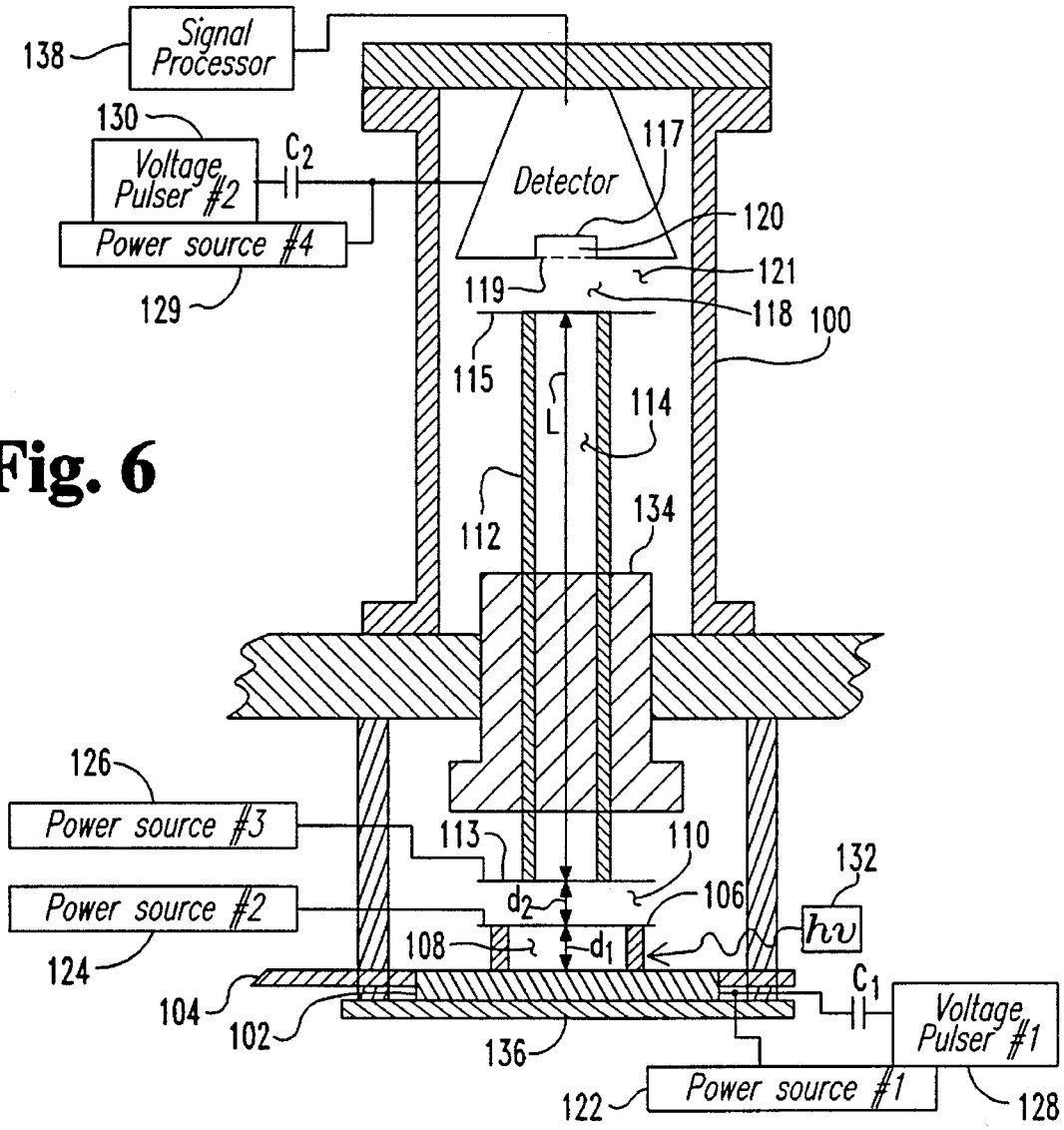
FIG. 6 is a cross-sectional diagrammatic illustration of a TOFMS in accordance with the present invention.

Referring now to FIG. 6, a time-of-flight mass spectrometer (TOFMS) 100 for spatial-velocity correlation focusing in accordance with tile present invention is shown in cross-section. As will be more fully explained hereinafter, power sources 122 and 124, and voltage pulser 128 are actuated with specific timing and magnitudes, depending on the internal geometry of the TOFMS 100 and the ion generation geometry, to simultaneously minimize the effects of the initial position distribution and initial velocity distribution of the generated ions on the mass resolution of the TOFMS. In a preferred embodiment, power sources 122, 124, 126, and 129 are DC high voltage power supplies. Alternatively, supplies 122, 124, 126, and 129 may supply time dependent voltages that optimally modify the spatial and velocity distributions of the ions before application of the output from voltage pulser 128. Careful selection of these and other TOFMS parameters significantly reduces the mass spectral peak broadening due to the two distributions.

Voltage plate 102 and voltage grid 106 are arranged in a juxtaposed relationship and define a first region 108 therebetween. Region 108 has length $d_1$ and contains the sample source 104. Although sample source 104 is shown as being located within a groove of voltage plate 102 so that the surface of the sample source 104 is coextensive with the surface of plate 102, the present invention contemplates locating sample source 104 at a variety of locations within region 108 as will be subsequently explained with reference to FIGS. 7–9.

In a preferred embodiment, sample source 104 is a stainless steel surface with the sample deposited thereon. Alternatively, sample source 104 may be a conductive metal grid, a dielectric surface with or without a thin metallic film coating or a comparable structure having an orifice through which sample molecules flow.

In a preferred embodiment, voltage plate 102 is a flat, highly conductive, metallic plate having a groove through the center of its surface for receiving the sample source 104. Voltage grid 113 is juxtaposed with voltage grid 106 and a second region 110 of length $d_2$ is defined therebetween. A flight tube 112 is connected between voltage grid 113 and grid 115. Flight tube 112 is constructed of a conducting material, typically aluminum, and has a channel 114 disposed therethrough which defines an ion drift region of length L. Ion detector 116 is juxtaposed with the grid 115 of flight tube 112 and a third region of length $d_3$ is defined between grid 115 and surface 117 of detector 116. In a preferred embodiment, detector 116 is a tandem microchannel plate array detector. Supports 134 and 136 are used to stabilize flight tube 112 and voltage plate 102 respectively within the TOFMS 100, and are preferably made of Teflon™. In one embodiment, grids 106, 113 and 115 are constructed of high conductivity metal having slits or apertures disposed therethrough so that ions may pass through. In an alternative embodiment, grids 106, 113 and 115 comprise high conductivity metallic plates having a central hole, or a series of holes disposed through the center, for allowing the passage of ions.

A first DC power source 122 is connected to voltage plate 102 for supplying a predetermined DC voltage potential $V_0$ thereto and a second DC power source 124 is connected to voltage grid 106 for supplying another predetermined DC voltage potential $V_2$ thereto. Although $V_0$ and $V_2$ may be widely varied, such as within the range of ±30 kV for example, both plate 102 and grid 106 are typically maintained at the same voltage, and in one embodiment, this voltage is 15 kV. A first voltage pulser 128 is connected to the first DC power supply 122 and also through a capacitor $C_1$ to voltage plate 102 for supplying a predetermined duration voltage pulse to plate 102 of a predetermined amplitude. In a preferred mode of operation, voltage pulser 128 supplies a voltage pulse $V_p$ to voltage plate 102 so that the total voltage present at plate 102 $V_1$ is the sum of the DC voltage $V_0$ and the voltage pulse $V_p$, thereby establishing an electric field $E_1$ of predetermined strength within the first region 108 for the duration of the pulse. In an alternate embodiment, the output of voltage pulser 128 may be used to change the electric field that had previously been established across region 108 by power sources 122 and 124. Voltage pulser 128 may further be connected to grid 106 instead of plate 102. Alternatively, any known method of establishing an electric field $E_1$ within region 108, of sufficient magnitude and duration, may be used. This electric field $E_1$ established within the first region 108 acts to accelerate positively charged ions present within the region 108 toward the ion detector 116. As previously stated, the electric field $E_1$ could be reversed to accelerate negatively charged ions toward the detector 116.

A third DC power source 126 is connected to voltage grid 113 for supplying a predetermined DC voltage potential $V_3$thereto. Although the voltage $V_3$ on grid 113 may also be widely varied, such as within the range of ±30 kV for example, this voltage is, in operation, maintained below the voltage on grid 106 so that a second electric field $E_2$ is established within region 110 for further accelerating positively charged ions entering region 110 toward the detector 116. In one embodiment, the voltage on grid 113 is maintained at approximately 12 kV.

A fourth DC power source 129 and a second voltage pulser 130 are connected to the detector 116. In operation, the fourth DC power source 129 supplies a constant potential $V_4$ to the detector 116 of sufficient magnitude to establish an electric field $E_3$ for further accelerating ions entering region 118 toward the detector 116. Although the voltage $V_4$ on the detector 116 may be widely varied, such as within the range of ±30 kV for example, $V_4$ is typically set at approximately −1.4 kV. In one embodiment, voltage pulser 130, capacitively coupled to the detector 116 through a capacitor $C_2$, supplies a voltage pulse to the detector 116 to increase the gain of the detector 116 for the duration of the pulse to facilitate data capture. In alternative embodiments, other known methods of momentarily increasing the gain of the detector 116 may be used to enhance data capture or data capture may be enhanced by preventing, through the use of pulsed ion deflectors, unwanted ions from reaching the detector.

Finally, a laser 132 is focused on the sample source 104 for generating ions therefrom. Typically, the laser is pulsed and it is assumed that ions are desorbed from the sample source 104 upon being subjected to the laser radiation pulse. Although a laser 132 is used to generate the ions in a preferred embodiment, the present invention may be used with systems employing other ion generation methods as well, including, for example, fast atom bombardment (FAB), plasma desorption (PD), secondary ion generation such as that used in secondary ion mass spectrometry (SIMS), electron bombardment and the like.

Ion time-of-flight within a TOFMS, such as TOFMS 100, is typically mathematically modeled by breaking down the flight path into a series of segments, determining the ion flight time within each segment, and then summing the flight times of the various segments to arrive at a total ion flight time. A variable number of segments may be used to mathematically model the flight time in a time-of-flight instrument. In the example that follows, the TOFMS 100 flight path is broken down into four segments corresponding to regions 108, 110, 114 and 118. Alternatively, for example, region 118 could be further broken down into region 121, extending between grid 115 and the dotted line 119, and region 120, extending between the dotted line 119 and the surface 117 of the detector 116, in which case the flight path would lave five segments.

Using the four segment approach, in a preferred embodiment where power supplies 122, 124, 126, and 129 provide DC voltages, the flight time $t_1$ of ions within region 108 is a function of the component of the initial ion velocity along the flight tube axis (parallel to the electric fields $E_1$–$E_3$) $v_0$, the velocity of the ions leaving region 108 $v_1$ and the acceleration strength $a_1$ of the electric field $E_1$ established within region 108. Thus, $$t_1=(v_1-v_0)/a_1 \quad (3).$$

If $X_0$ is the position of a particular ion generated from the sample source 104, then $$v_1=\sqrt{2a_1(d_1-X_0)+v_0^2} \quad (4)$$

Similarly, the flight time $t_2$ of ions within region 110 is a function of the velocity of ions entering region 110 $v_1$, the velocity of ions leaving region 110 $v_2$ and the acceleration strength of the electric field $E_2$ established within region 110. Thus, $$t_2=(v_2-v_1)/a_2 \quad (5),$$

where $$v_2=\sqrt{2a_2d_2+v_1^2}\ . \quad (6)$$

Furthermore, the flight time $t_4$ of ions within region 118 is a function of the velocity of ions entering region 118 $v_2$, the velocity of ions leaving region 118 $v_3$ and the acceleration strength $a_3$ of the electric field $E_3$established within region 118. Thus, $$t_4=(v_3-v_2)/a_3 \quad (7),$$

where $$v_3=\sqrt{2a_3d_3+v_2^2}\ . \quad (8)$$

Finally, since region 114 is an electric field free ion drift region, the ion flight time $t_3$ is a function only of the ion velocity $v_2$ through region 114 and the length L of region 114. Thus, $$t_3=L/v_2 \quad (9).$$

Since the total ion flight time within the TOFMS 100 is the sum of the four flight time segments, the equation for the total flight time T within TOFMS 100 is $$T=f\,(a_1, a_2, a_3, d_1, d_2, d_3, L, X_0, v_0) \quad (10)$$

Using equation (10), the limitations of the prior art space focusing technique described in the background section can be readily understood. In implementing the space focusing technique, the initial ion position and initial ion velocity are independent variables and the derivative of equation (10) is taken with respect to initial ion position $X_0$, which leads to $$\frac{\partial T}{\partial X_0}=\frac{-1}{v_1}+\frac{a_1}{a_2}\left(\frac{1}{v_1}-\frac{1}{v_2}\right)+\frac{a_1}{a_3}\left(\frac{1}{v_2}-\frac{1}{v_3}\right)+\frac{a_1L}{v_3^3}\ . \quad (11)$$

Setting equation (11) equal to zero, and recognizing that the acceleration terms $a_x$ are related to the voltage potential values on plate 102 and grids 106 and 113 and detector 116 via the well known relationships $$a_x=qE_x/m \quad (12)$$

and $$E_x=(V_x-V_{x+1})/d_x \quad (13),$$

where m is ion mass and q is ion charge, the ratio of electric fields $E_x$ can be determined. By choosing a value for a further parameter, such as a desired ion velocity within the ion drift region 114, it is readily observed that the space focusing technique permits only the relatively easy determination of the voltages $V_1$–$V_4$, given a selected set of region distances $d_1$–$d_3$ and L.

Figure 5:
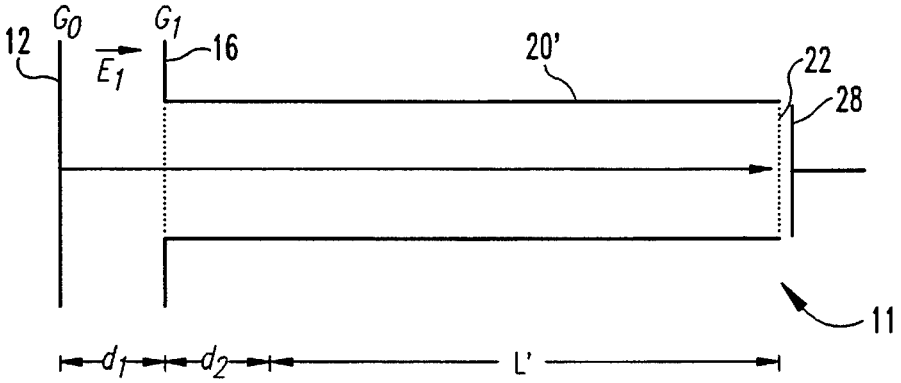
Fig. 5 (Prior Art)
FIG. 5 is a schematic diagram of a modified TOFMS of FIG. 4 illustrating a known technique for reducing the effect of a velocity distribution in ions generated from a sample surface on TOFMS mass resolution.

In contrast to the spatial focusing technique discussed above and the techniques discussed in reference to FIG. 5 for reducing the effects of initial ion velocity on mass spectral peak broadening, the present invention takes advantage of the fact that, in many time-of-flight instruments, depending upon the ion generation geometry, initial ion position is a function of initial ion velocity. This functional relationship can be exploited by determining the spatial-velocity correlation for the particular ion source geometry, substituting this correlation into the time-of-flight equation, such as equation (10) for TOFMS 100, to remove either $X_0$ or $v_0$ from equation (10), taking the derivative of new equation (10) with respect to the remaining variable (either $X_0$ or $v_0$), setting this derivative equal to zero and solving for the optimal instrument parameters. Alternatively, new equation (10) can be employed numerically to identify optimal instrument parameters. This is done by considering variations in all instrument parameters that affect ion time of flight, and searching for those parameters that minimize the spread of flight times with respect to changes in the remaining variable (either $X_0$ or $v_0$). In either case, if the initial ion position and initial ion velocity are correlated, the spatial-velocity correlation focusing technique reduces the total number of independent variables and independent distributions, and produces at least one additional adjustable parameter over the spatial focusing technique which, if optimized, results in the simultaneous minimization of the effect on TOFMS mass resolution of the correlated initial ion position and velocity distributions.

Figure 7:
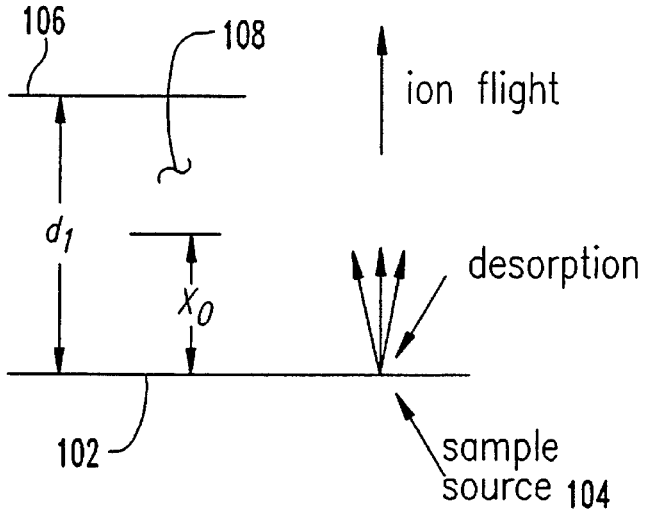
FIG. 7 is a schematic diagram of the ion formation portion of the TOFMS of FIG. 6 showing the relationship between initial ion position and initial ion velocity.
Figure 8:
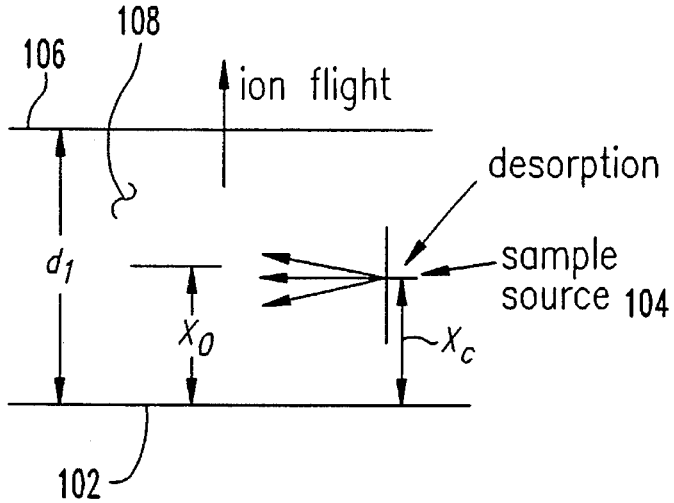
FIG. 8 is a schematic diagram of the ion formation portion of a TOFMS having an alternate ion generating geometry.
Figure 9:
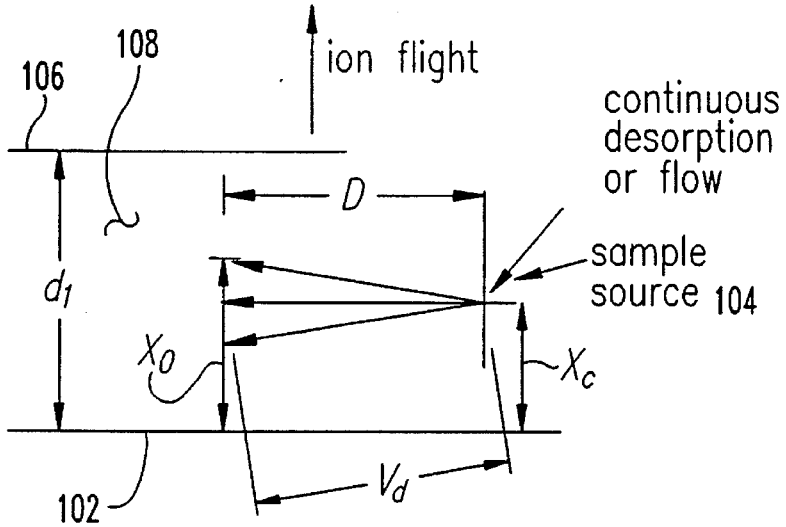
FIG. 9 is a schematic diagram of the ion formation portion of a TOFMS having another alternate ion generating geometry.

Referring now to FIGS. 7–9, the relationship between ion spatial and velocity distributions for three alternative ion source geometries will be described. The relational equations generated by these geometries may be directly substituted into a time-of-flight equation, such as equation (10) for TOFMS 100, to achieve spatial-velocity correlation focusing.

Referring to FIG. 7 specifically, the configuration of FIG. 6 is shown wherein the sample source 104 is disposed upon, or coextensive with, voltage plate 102, and ions are desorbed by laser 132 in a direction perpendicular to voltage grid 106 (parallel with electric field $E_1$). With the geometry of FIG. 7, initial ion position $X_0$ within region 108 is related to the initial ion velocity component along the flight tube axis, (i.e. perpendicular to grid 106) $v_0$within region 108 by the equation $$x_0=\tau v_0 \quad (14),$$

where $\tau$ is the delay time between the generation of ions at the sample source 104 and commencement of the pulsed ion drawout electric field $E_1$, established via voltages $V_1$and $V_2$ at plate 102 and grid 106, respectively.

Referring to FIG. 8, an alternate ion source geometry is shown where the sample source is disposed within region 108 at a distance $X_c$ from plate 102, and the ions are desorbed by laser 132 in a direction parallel to grid 106 (perpendicular to electric field $E_1$). With the geometry of FIG. 6, initial ion position within region 108 is related to initial ion velocity component along the flight tube axis $v_0$ within region 108 by the equation $$X_0=X_c+\tau v_0 \quad (15),$$

where $\tau$ is again the delay time between the generation of ions at the sample source and commencement of the ion pulsed drawout electric field $E_1$, established via voltages $V_1$and $V_2$ at plate 102 and grid 106, respectively.

Referring to FIG. 9, another alternate ion source geometry is shown where the sample source is disposed within region 108 at a distance $X_c$ from plate 102, and the ions continuously flow in a direction parallel to grid 106 (perpendicular to electric field $E_1$). The distance between the sample source 104 and the point where ion acceleration begins is the distance D. In an alternative embodiment, neutral molecules continuously flow from sample source 104 to a distance D where they are ionized by laser light, electron impact or some other ionization means. With the geometry of FIG. 9, initial ion position within region 108 is related to initial ion velocity component along the flight tube axis $v_0$ within region 108 by the equation $$X_0=X_c+\frac{v_0 D}{\sqrt{v_d^2-v_0^2}}, \quad (16)$$

where $v_d$ is the amplitude of the total velocity of the generated ions. Although equation 16 does not generate the new variable $\tau$, it does effectively eliminate either the velocity or spatial distribution from equation 10 by substitution.

Using equations (10) and (14), an example of the derivative method for performing spatial-velocity correlation focusing with TOFMS 100 of FIG. 6 will be given. First, equation (14) is solved for $X_0$ and substituted into equation (10), resulting in $$T=f(a_1, a_2, a_3, d_1, d_2, d_3, L, v_0, \tau) \quad (17).$$

Equation (17) represents the ion time-of-flight within TOFMS 100, independent of the initial positions of the ions generated from the sample source 104. Alternatively, equation (14) could have been substituted directly into equation (10) to achieve an expression for ion time-of-flight within TOFMS 100 that is independent of the initial velocities of the ions generated from the sample source 104. In any event, taking the derivative of equation (17) with respect to initial ion velocity $v_0$ yields $$\frac{\partial T}{\partial v_0}=f'(a_1, a_2, a_3, d_1, d_2, d_3, L, v_0, \tau). \quad (18)$$

By setting equation (18) equal to zero and solving for $\tau$, the optimal delay time between generating ions from the sample source 104 and commencing the pulsed drawout electric field $E_1$ can be determined. If the derivative of equation (18) is further taken with respect to initial ion velocity $v_0$, and set equal to zero, the optimal voltage $V_1$ can be obtained for determining the amplitude $V_p$ of the first voltage pulser 128. Utilizing the optimal values for $\tau$ and $V_p$ in the operation of TOFMS 100, and optimizing the remaining TOFMS 100 parameters, results in minimizing the time spread of the mass peaks in the TOFMS mass spectra.

In the alternate embodiments discussed above, the field $E_1$ may be non-zero and even time dependent before the time $\tau$ when ion drawout occurs. In these cases, numerical optimization of instrument parameters for the purpose of minimizing ion time-of-flight spread and optimizing mass spectral resolution may be preferred.

Figure 10:
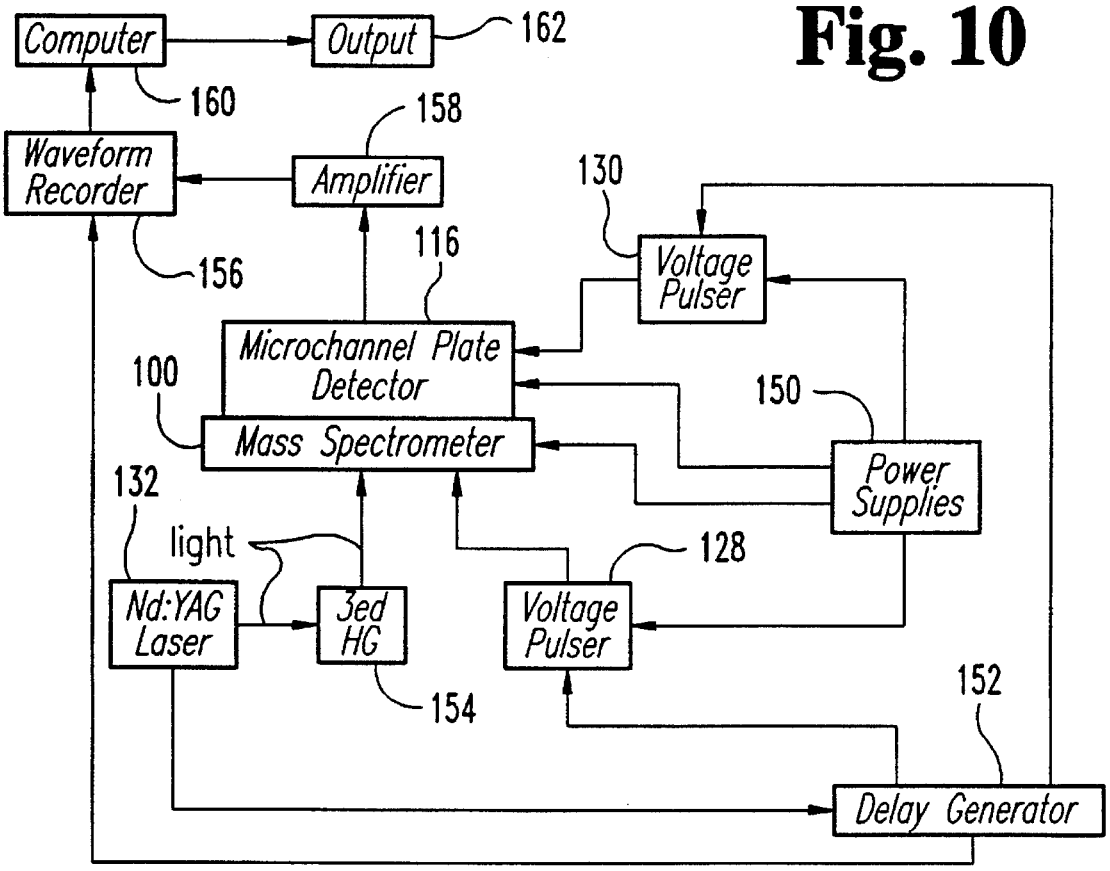
FIG. 10 is a block diagrammatic illustration of a system for performing spatial-velocity correlation focusing with a linear TOFMS in accordance with the present invention.

Referring now to FIG. 10, a system for implementing the foregoing spatial-velocity correlation focusing technique is shown. A TOFMS, such as TOFMS 100, along with the microchannel plate detector 116, are the central components of the system. All four of the DC power sources 122, 124, 126 and 129 shown in FIG. 6 are included in the power supplies 150 block which is connected to TOFMS 100 and detector 116. FIG. 6 should be consulted for specific power supply connections. The power supply block 150 is further connected to voltage pulsers 128 and 130 which are, in turn, connected to TOFMS 100 and detector 116 respectively. FIG. 6 should similarly be consulted for specific connections of these elements.

Laser 132 is, in a preferred embodiment, a Quanta Ray DCR-2 Nd:YAG laser at 1.06 microns, although the present invention contemplates using a variety of laser sources ranging from the far-UV to the far-IR. Radiation from laser 132 is frequency tripled by third harmonic generator 154 before being focused onto the sample source 104 within region 108 of TOFMS 100.

Laser 132 is further connected, either at its Q-switch output or through a photodiode that monitors the laser light pulse, to a delay generator 152 which, in turn is connected to voltage pulsers 128 and 130, and waveform recorder 156. Alternatively, a waveform recorder may be used that can record the entire time period from the desorption light pulse to the arrival of macromolecular ions at the detector. This type of waveform recorder can be triggered directly by the laser. In operation, ion generation is assumed to occur at the time of the laser light pulse, so that the delay time $\tau$ determined from equation (18) is measured from the time of the laser pulse. As such, the delay generator 152 is programmed with the optimal delay time $\tau$ and is operable to trigger voltage pulser 128 to thereby supply the voltage $V_p$ at the optimal time $\tau$ and with the optimal strength. Delay generator 152 further triggers the voltage pulser 130 and waveform recorder 156 at a delayed time after voltage pulser 128 is triggered so that the detector 116 and recorder 156 are properly prepared for receiving data. In a preferred embodiment, delay generator 152 is a Stanford Research Systems Pulse Generator, although other comparable precision delay generators may be used.

Detector 116 is further connected to a signal amplifier 158 which, in turn, is connected to the waveform recorder 156. In preferred embodiment, signal amplifier 158 is a LeCroy VV101ATB amplifier and waveform recorder 156 is a Biomation 6500 waveform recorder, although other comparable amplifiers, recorders, and digitizers may be used.

Finally, the output of the waveform recorder 156 is directed to a computer 160 from which an output 162 can be obtained in a variety of formats, including, for instance, hard copies, screen displays, disk storage, CD ROM storage, and the like. In a preferred embodiment, computer 160 is an IBM compatible personal computer, although a variety of computers may be used, such as any type of personal computer, notebook computer, or lap-top computer, mainframe or network computer.

Figure 11:
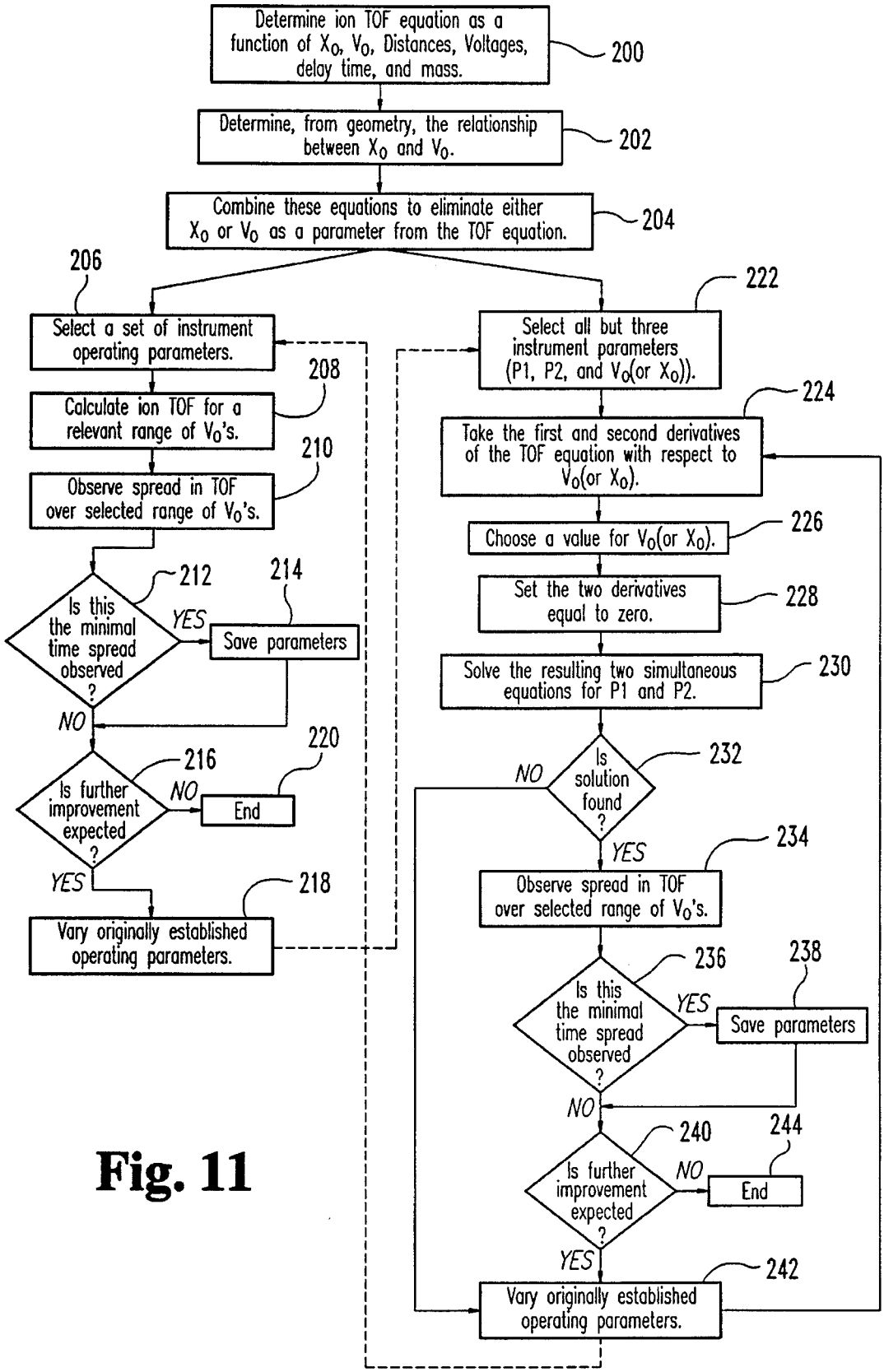
FIG. 11 is a flow chart of a method for determining spatial-velocity correlation focusing conditions for use with a linear TOFMS in accordance with the present invention.

Referring now to FIG. 11, a flow chart is shown for performing spatial-velocity correlation focusing in a time-of-flight instrument having an ion source geometry wherein initial position ion distribution is a function of the initial ion velocity distribution. At step 200, an equation is determined for the time-of-flight of ions within the time-of-flight instrument. The TOF equation is a function of initial ion position $X_0$, initial ion velocity $v_0$, distances traveled by the ions $d_x$, the various voltages applied to the various grids within the time-of-flight instrument for creating ion accelerating electric fields, ion mass and delay time $\tau$ between the generation of ions within the instrument and the commencement of ion acceleration. An example of such an equation is given by equation (10) above.

Algorithm execution continues at step 202 where a second equation is determined, from the ion source geometry, relating $X_0$ to $v_0$. At step 204, the second equation is substituted into the TOF equation to eliminate either $X_0$ or $v_0$ as a parameter of the TOF equation.

In one embodiment of the present invention, the algorithm continues from step 204 to step 206 where initial values for the parameters of the TOF equation of step 204 are chosen. At step 208, ion times-of-flight are calculated over a predicted range of either $X_0$ or $v_0$, depending on which of these parameters remains in the TOF equation of step 204. Preferably, the predicted range of either $X_0$ or $v_0$ has been experimentally determined for the type of time-of-flight instrument being used.

Algorithm execution continues at step 210 where the variations in $v_0$ of step 208 are entered into the TOF equation of step 204 and the variations in the ion times-off-flight are observed. In a preferred embodiment, the time-of-flight variations are observed graphically. The observed spread in the times-of-flight indicates the magnitude of the ion peak width that can be expected to occur in the experimental mass spectrum. If, at step 212, minimal time spreads are observed, the instrument parameters are saved at step 214 and the algorithm continues at step 216. The time spreads at step 212 are considered to be minimal if an improvement in time spreads is observed over previous calculated time spreads.

If the instrument parameters were saved at step 214, or if the observed time spread was not minimal at step 212, the current instrument operating parameters chosen at step 206 or 218 are examined for possible improvement in the time spread. If no further improvement in the time spread is deemed possible at step 216 by further varying the instrument parameters, or if all possible combinations of parameters have been considered, the algorithm is ended at step 220. If, at step 216, further improvement in expected in the time spread by varying the instrument parameters, the instrument parameters are varied and the algorithm returns to step 208.

In an alternate embodiment of the present invention, the algorithm continues from step 204 at step 222 where initial values for all but three of the parameters of the TOF equation of step 204 are chosen; two desired parameters P1 and P2, and either $X_0$ or $v_0$, depending upon which of these latter two variables are present within the TOF equation. At step 224, the first and second derivatives of the TOF equation of step 204 are taken with respect to either $X_0$ or $v_0$, depending upon which of these variables is present in the TOF equation. At step 226, a value is chosen for $X_0$ or $v_0$, preferably through experimentation. At step 228, the two derivatives are set equal to zero. At step 230, the two simultaneous derivative equations of step 228 are solved for the parameters P1 and P2.

At step 232, the status of a solution to the equations of step 230 is tested. If no solution to the simultaneous equations of step 230 is found, algorithm execution continues at step 242. If, at step 232, a solution to the simultaneous equations of step 230 is found, the parameters chosen in steps 222 and 230 are entered into the TOF equation of step 204, and the variations in the ion times-of-flight generated by variations in $v_0$ or $X_0$ are observed at step 234. The observed spread in the times-of-flight indicates the magnitude of the ion peak width that can be expected to occur in the experimental mass spectrum. If, at step 236, minimal time spreads are observed, the instrument parameters are saved at step 238 and the algorithm continues at step 240. The time spreads at step 236 are considered to be minimal if an improvement in the time spreads is observed over previous calculated time spreads.

If the instrument parameters were saved at step 238, or if the observed time spread was not minimal at step 236, the current instrument operating parameters chosen at steps 222 and 230 are examined for possible improvement in the time spread by varying the instrument parameters at step 240. If no further improvement in the time spread is deemed possible at step 240 by further varying the instrument parameters, or if all possible combinations of parameters have been considered, the algorithm is ended at step 244. If, at step 240, further improvement in expected in the time spread by varying the instrument parameters at step 242, the instrument parameters are varied and the algorithm returns to step 224. In a preferred embodiment, the parameters P1 and P2 are chosen to be the time delay $\tau$ and the magnitude of the voltage $V_p$.

As exemplified by the dashed line from step 218 to step 222, and the dashed line from step 242 to step 206, the two foregoing algorithm embodiments are not necessarily mutually exclusive. In other words, after traversing steps 206–218 of the first algorithm embodiment, the algorithm may continue at step 222 rather than returning to step 208. Similarly, after traversing steps 222–242 of the second algorithm embodiment, the algorithm may continue at step 206 rather than returning to step 224.

With any of the algorithm embodiments discussed above, variation of parameters may be accomplished by considering all combinations of parameters, Alternatively, a variety of optimization methods, such as Simplex optimization, for example, may be employed to guide the selection of parameters. Parameter variation may also be based on operator observation of the calculated spread in TOF, or can be based on experimental results.

EXPERIMENTAL RESULTS

Figure 1:
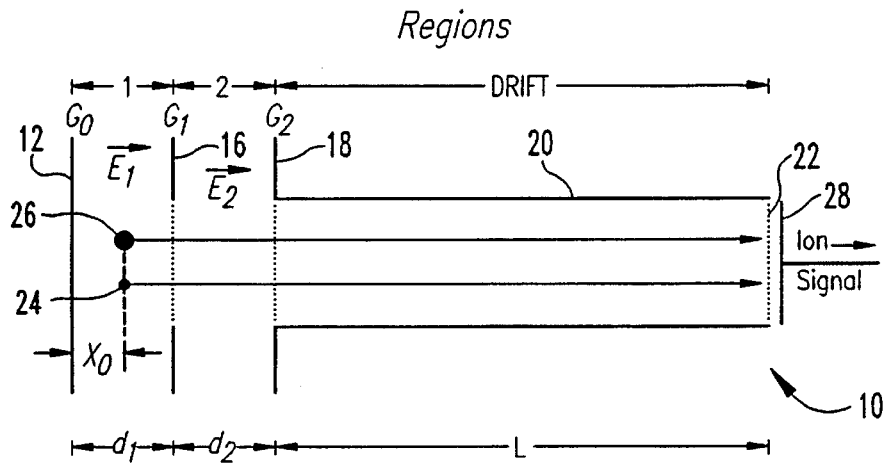
Fig. 1 (Prior Art)
FIG. 1 iS a schematic diagram of a typical two-stage linear time-of-flight mass spectrometer (TOFMS) of the prior art.
Figure 2:
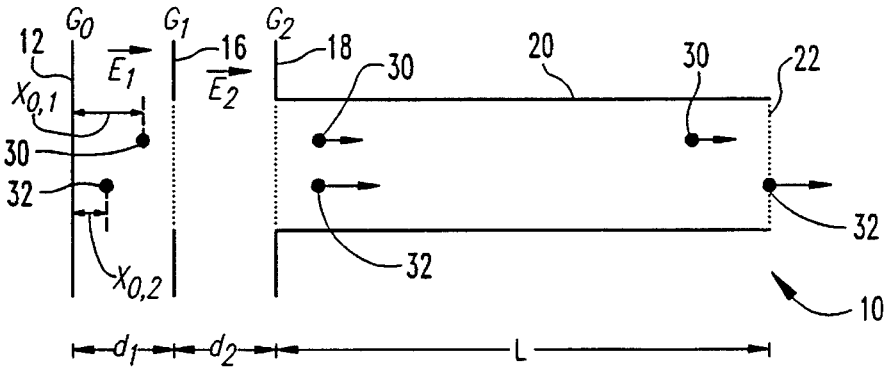
Fig. 2 (Prior Art)
FIG. 2 is a schematic diagram of the TOFMS of FIG. 1 illustrating the effect on flight time of a spatial distribution in the generated ions.
Figure 3:
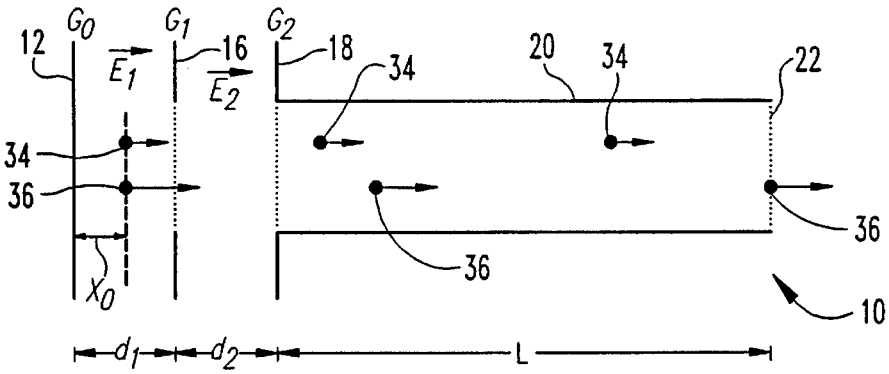
Fig. 3 (Prior Art)
FIG. 3 is a schematic diagram of the TOFMS of FIG. 1 illustrating the effect on flight time of a velocity distribution in the generated ions.
Figure 4:
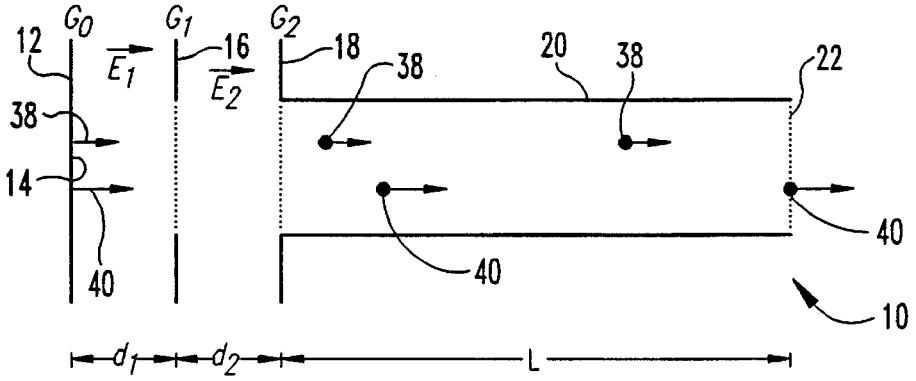
Fig. 4 (Prior Art)
FIG. 4 is a schematic diagram of the TOFMS of FIG. 1 illustrating the effect on ion flight time of a velocity distribution in ions generated from a sample surface.

Referring now to FIGS. 12–19, experimental results are shown comparing ion time-of-flight peak widths for Bovine Insulin (m/z 5733), Cytochrome-c (m/z 12,360 da, Lysozyme (m/z 14,306 da) and Trypsinogen (m/z 23,981 da) using MALDI. In these experiments, a TOFMS 100, such as that shown in FIG. 4 was used wherein a 3 ns, 355 nm laser pulse was focused onto the sample spot with a 15 cm focal length spherical lens at an incidence angle of approximately 80 degrees from the flight axis. Power densities were on the order of 1–5 $MW/cm^2$ and pressure in the TOFMS was approximately $1\times10^{-6}$ torr.

Sample preparation consisted of dissolving the proteins in distilled deionized water to concentrations of $1.67\times10^{-4}$ M. The ferulic acid matrix was dissolved in neat ethanol to a concentration of 0.125M. A sample solution was obtained by mixing three parts protein stock solution with two parts matrix solution. The final concentrations were approximately $1\times10^{-4}$M and 50 mM for the protein and matrix, respectively. Aliquots of the sample solution (5 microliters) were then deposited on a stainless steel probe (sample source 104) and allowed to air dry before insertion into the TOFMS 100.

Figure 12:
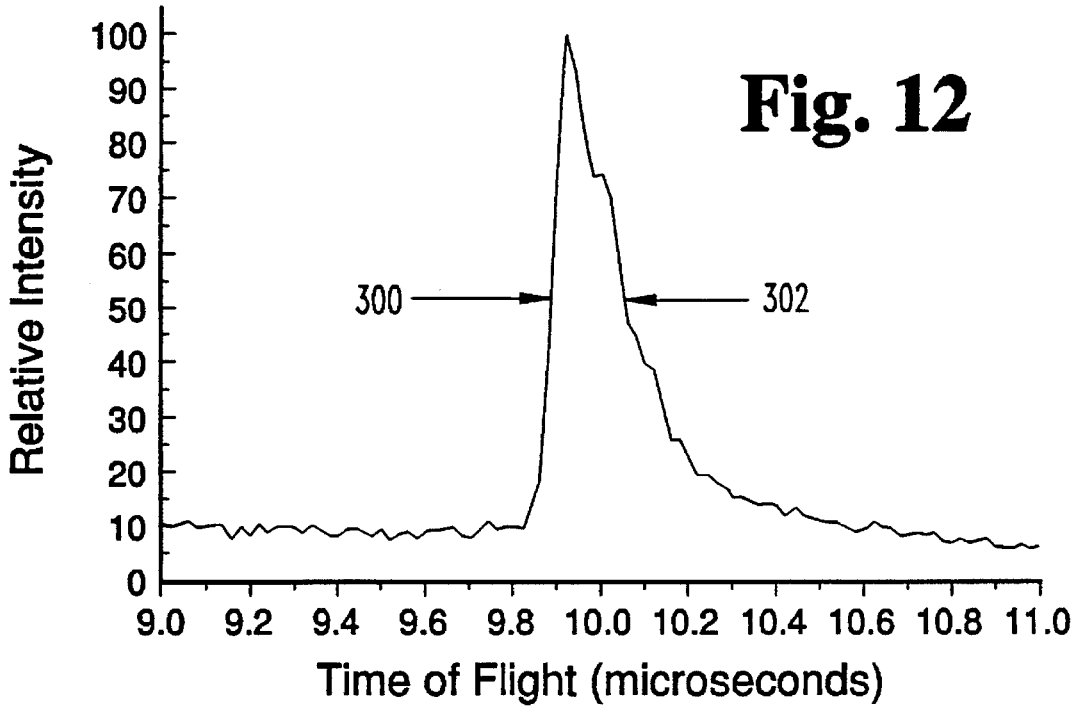
FIG. 12 iS an experimental MALDI-TOF mass spectrum of Insulin obtained using traditional MALDI techniques.
Figure 13:
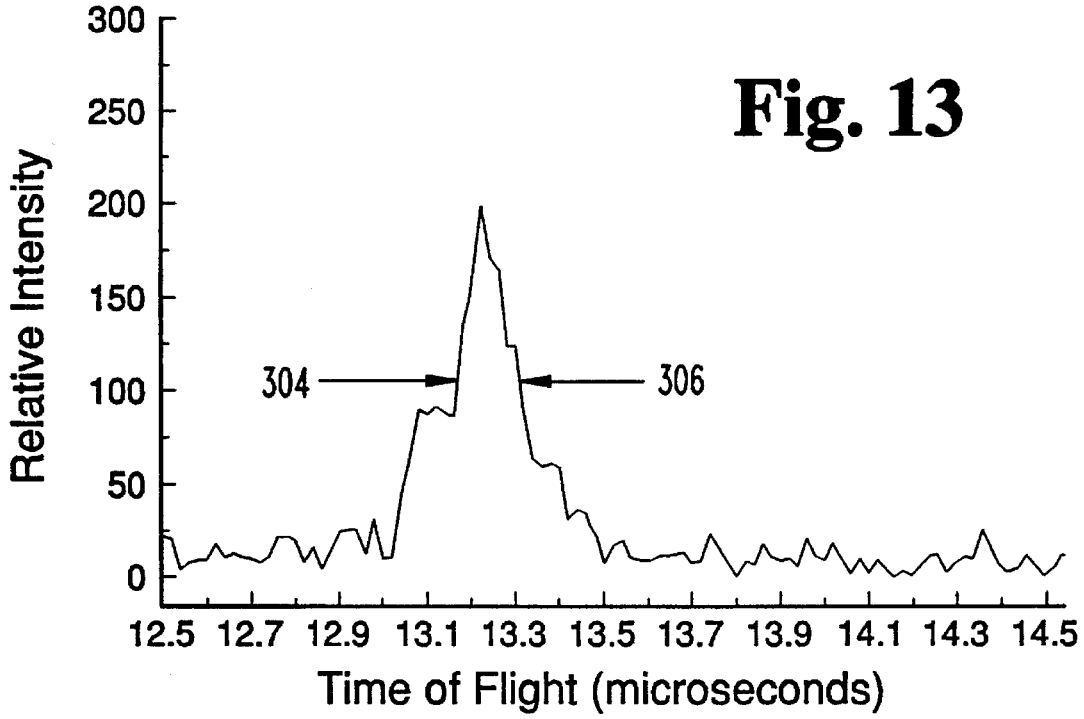
FIG. 13 is an experimental MALDI-TOF mass spectrum of Cytochrome-c obtained using traditional MALDI techniques.
Figure 14:
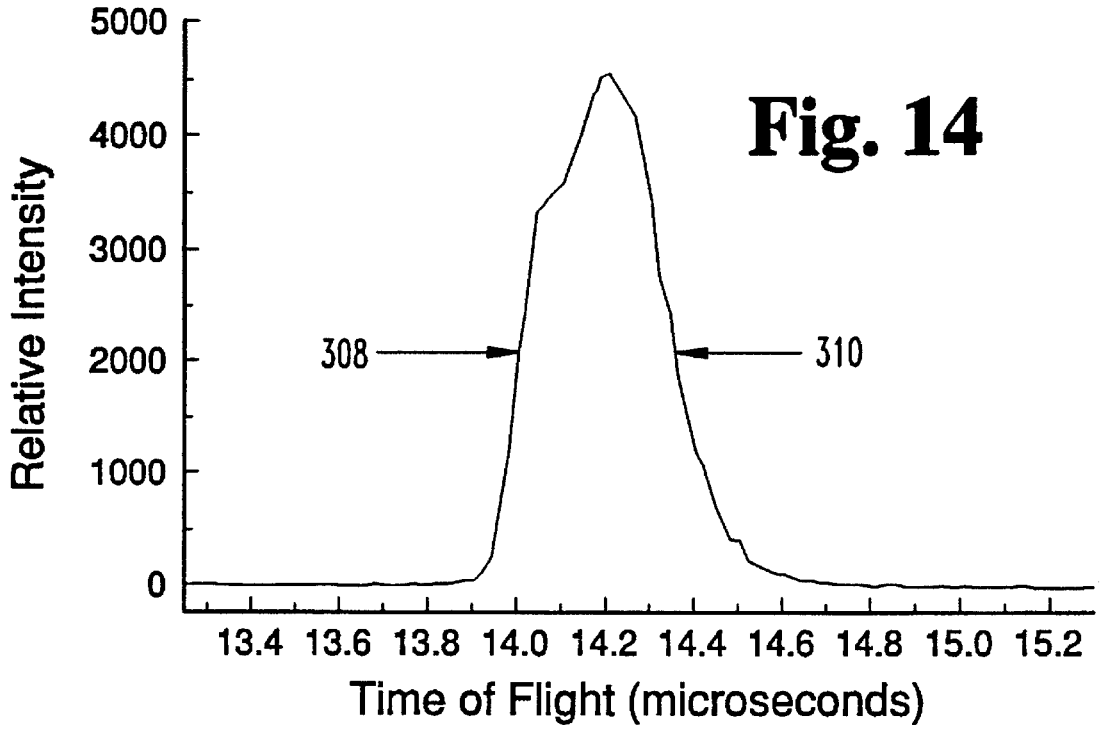
FIG. 14 is an experimental MALDI-TOF mass spectrum of Lysozyme obtained using traditional MALDI techniques.
Figure 15:
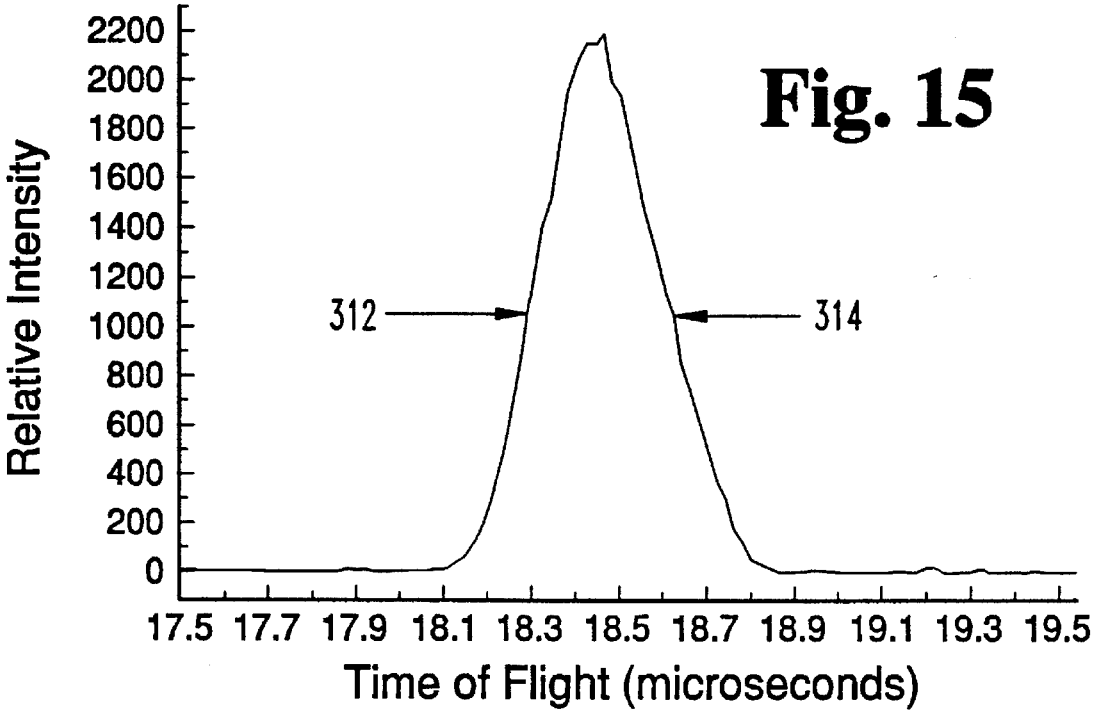
FIG. 15 is an experimental MALDI-TOF mass spectrum of Trypsinogen obtained using traditional MALDI techniques.

FIGS. 12–15 display ion intensity versus time-of-flight data generated for the Insulin sample, Cytochrome-c sample, Lysozyme sample, and Trypsinogen sample, respectively, using traditional MALDI techniques wherein the TOFMS 100 was configured similar to the TOFMS 10 shown in FIG. 5. For the spectra of FIGS. 12–15, $V_1$ and $V_3$ were approximately 30 kV and 0 V, respectively. $V_4$ was pulsed to −1.9 kV at the time of data acquisition. As shown in FIG. 12, the Insulin had a peak width indicated by arrows 300 and 302 of approximately 160 ns. As shown in FIG. 13, the Cytochrome-c had a peak width, indicated by arrows 304 and 306, of approximately 160 ns. As shown in FIG. 14, the Lysozyme had a peak width, indicated by arrows 308 and 310, of approximately 340 ns. Finally, as shown in FIG. 15, the Trypsinogen had a peak width, indicated by arrows 312 and 314, of approximately 340 ns.

Figure 16:
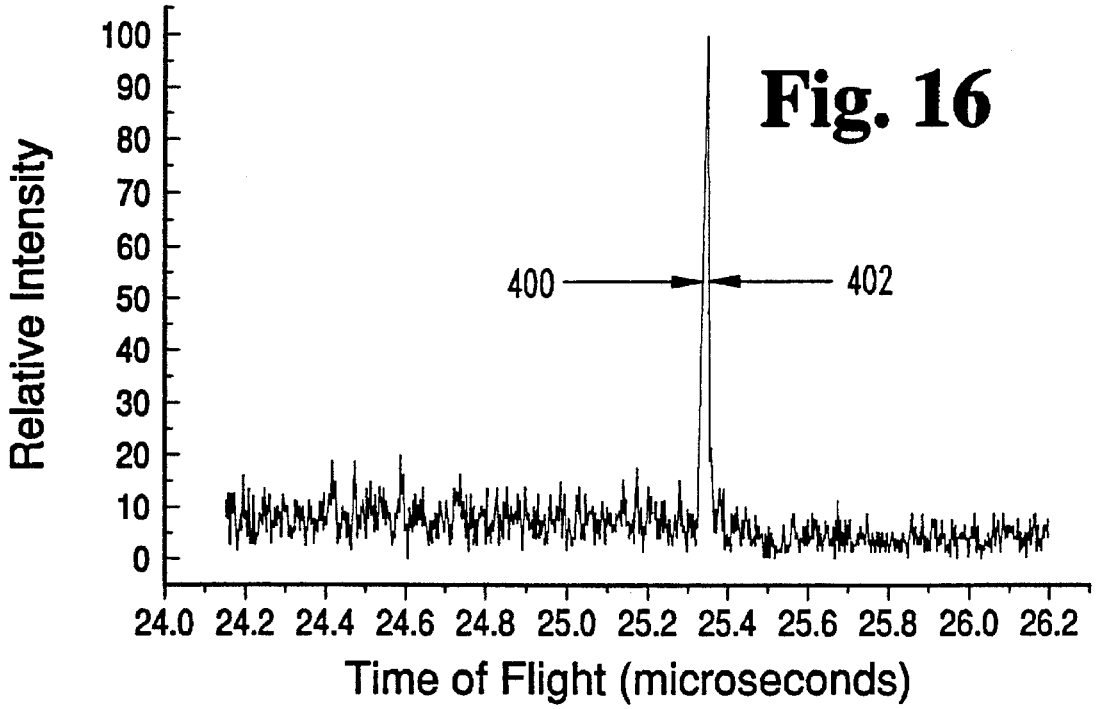
FIG. 16 is an experimental MALDI-TOF mass spectrum of Insulin obtained using spatial-velocity correlation focusing conditions in accordance with the present invention.
Figure 19:
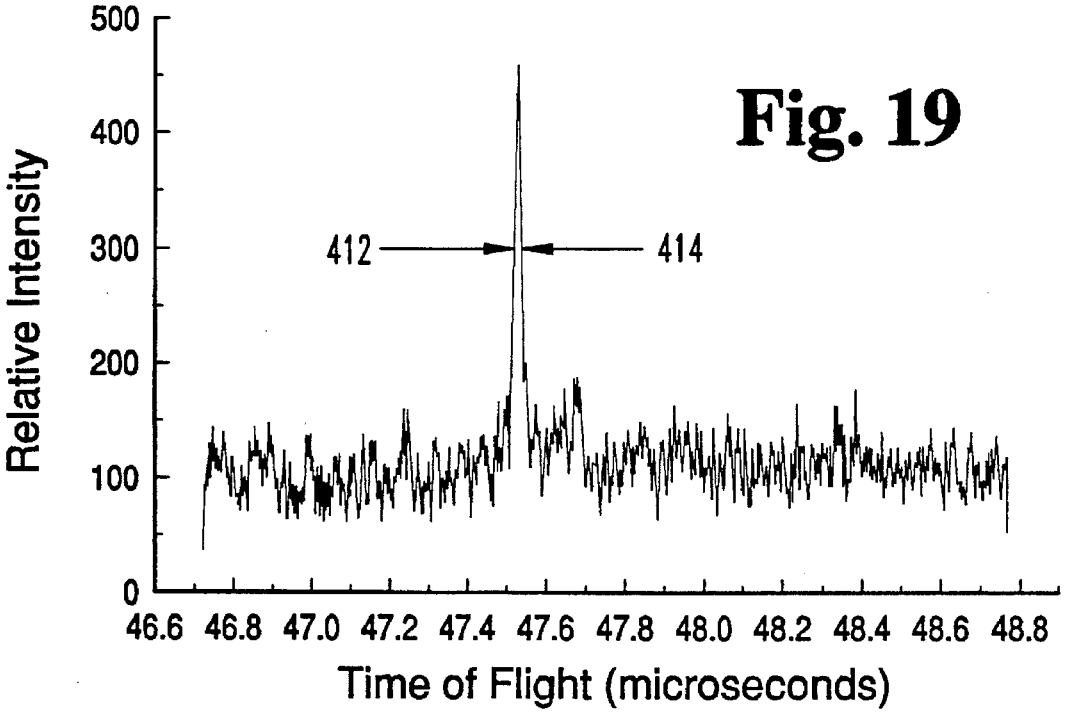
FIG. 19 is an experimental MALDI-TOF mass spectrum of Trypsinogen obtained using spatial-velocity correlation focusing conditions in accordance with the present invention.

Referring now to FIGS. 16 and 19, ion intensity versus time-of-flight data were again generated for the Insulin sample, Cytochrome-c sample, Lysozyme sample, and Trypsinogen sample, respectively, using MALDI techniques wherein spatial-velocity correlation focusing, in accordance with the present invention, was performed to reduce ion peak broadening.

In this particular case, the distances $d_1$, $d_2$, L and $d_3$ were 12.05 mm, 13.34 mm, 210.81 mm and 27.26 mm, respectively.

For the Insulin sample, the algorithm of FIG. 11 was employed to determine optimal operating conditions for TOFMS 100. As a result, plate 102 and grid 106 were initially set at 15 kV, and after a delay time of 2.25 microseconds, plate 102 was pulsed from 15 kV to 16.8 kV. Plate 113 was maintained at 12.06 kV. As a variation on the geometry of the detector 116, a grid was placed at the dotted line 119 shown in FIG. 6, and was held at ground potential. The distance between the grid 115 and the new grid 119 was 22.06 mm. The detector 116 was pulsed from −1.4 kV to −1.9 kV a predetermined time period after the pulsing of plate 102. The front surface 117 of the detector 116 was located at a distance of 5.2 mm from grid 119. As shown in FIG. 16, the Insulin sample had a peak width, indicated by arrows 400 and 402, of approximately 12 ns. The improvement over the 160 ns peak of FIG. 12 represents approximately a 93% peak width reduction and is due to the spatial-velocity correlation focusing techniques of the present invention.

Figure 17:
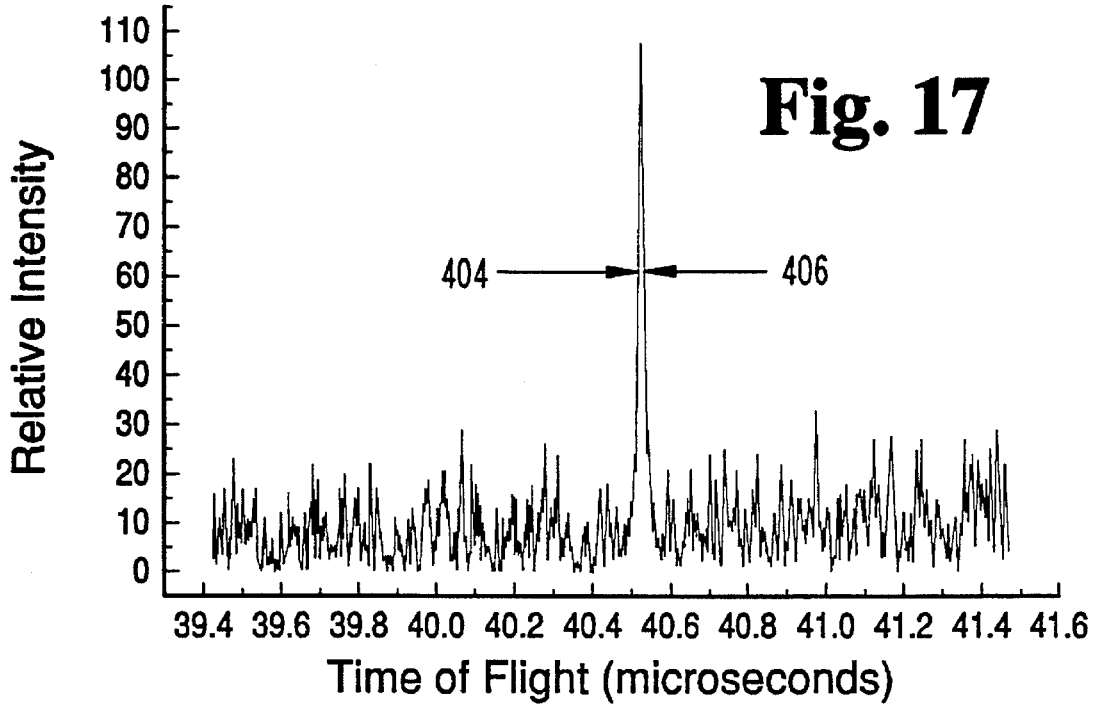
FIG. 17 is an experimental MALDI-TOF mass spectrum of Cytochrome-c obtained using spatial-velocity correlation focusing conditions in accordance with the present invention.

For the Cytochrome-c sample, the algorithm of FIG. 11 was similarly employed to determine optimal operating conditions for TOFMS 100. As a result, plate 102 and grid 106 were initially set at 15 kV, and after a delay time of 6.9 microseconds, plate 102 was pulsed from 15 kV to 16.437 kV. Grid 113 was maintained at 12.5 kV. As shown in FIG. 17, the Cytochrome-c sample had a peak width, indicated by arrows 404 and 406, of approximately 12 ns. The improvement over the 160 ns peak of FIG. 13 represents approximately a 93% peak width reduction and is due to the spatial-velocity correlation focusing techniques of the present invention.

Figure 18:
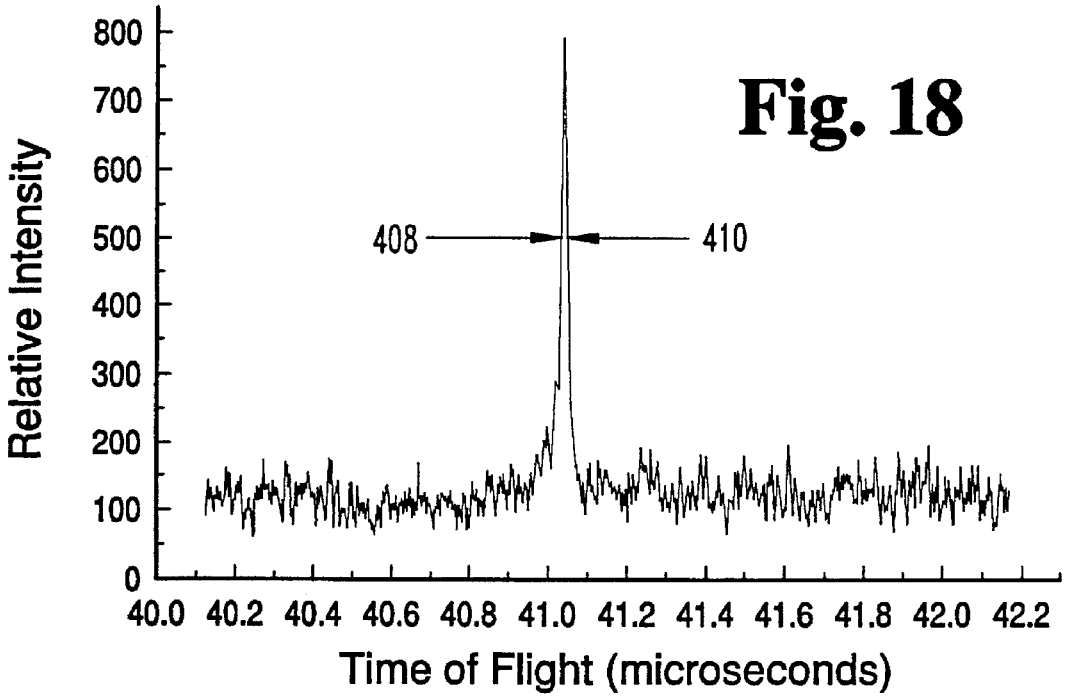
FIG. 18 is an experimental MALDI-TOF mass spectrum of Lysozyme obtained using spatial-velocity correlation focusing conditions in accordance with the present invention.

For the Lysozyme sample, the algorithm of FIG. 11 was similarly employed to determine optimal TOFMS 100 conditions. As a result, plate 102 and grid 106 were initially set at 15 kV, and after a delay time of 5.6 microseconds, plate 102 was pulsed from 15 kV to 16.586 kV. Grid 113 was maintained at 11.5 kV and the detector 116 voltage was operated identically as with the Cytochrome-c sample. As shown in FIG. 18, the Lysozyme sample had a peak width, indicated by arrows 408 and 410, of approximately 12 ns. The improvement over the 340 ns peak width of FIG. 14 represents approximately a 96% peak width reduction and is due to the spatial-velocity correlation focusing techniques of the present invention.

For the Trypsinogen sample, the algorithm of FIG. 11 was once more employed to determine optimal TOFMS 100 conditions. As a result, plate 102 and grid 106 were initially set at 15 kV, and after a delay time of 6.7 microseconds, plate 102 was pulsed from 15 kV to 16.981 kV. Grid 113 was maintained at 10.5 kV and the detector 116 voltage was operated identically as with the previous two samples. As shown in FIG. 19, the Trypsinogen sample also had a peak width, indicated by arrows 412 and 414, of approximately 12 ns. As with the previous sample, the improvement over the 340 ns peak width of FIG. 15 represents approximately a 96% peak width reduction and is due to the spatial-velocity correlation focusing techniques of the present invention.

In addition to the fact that the method of space velocity correlation focusing enables simultaneous ion spatial and velocity focusing, two additional advantages over the traditional MALDI approach of using a high DC ion drawout field accrue. First, in a high ion drawout field, variations in sample morphology, that correspond to variations in the locations at which ions are produced, and likewise to variations in electrostatic potential at these points of formation, lead to significant variations in ion time-of-flight. Since with space velocity correlation focusing, drawout electric fields are smaller, variations in electrostatic potential caused by variations in ion formation locations are smaller. This, in conjunction with the fact that ion times of flight are spatially focussed, leads to correspondingly smaller ion flight time variations.

Second, in a DC ion drawout field, as in the traditional MALDI approach, variations in ion formation time in the source region lead directly to variations in measured ion flight times. However, with pulsed ion drawout, ion flight time is measured with respect to the onset of the ion drawout pulse. Variations in ion formation time (that occur preceding the drawout pulse) lead to variations in ion position in the source region at the time of the ion drawout pulse that are spatially focussed. Consequently, observed ion flight time variations can be significantly smaller than variations in ion formation time.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, the term "ion" in the description of the preferred embodiment applies equally to ions directly desorbed from a sample surface and to neutrals desorbed from a sample surface and subsequently ionized. Furthermore, a timed electric field $E_1$ has been disclosed as being generated by applying a voltage pulse at plate 102 such that the voltage at plate 102 is greater than the voltage at grid 106 for the duration of the pulse. Alternatively, the electric field $E_1$ may be established by varying the potential applied to grid 106. Finally, the spatial-velocity correlation focusing techniques described herein are applicable to any time-of-flight instruments wherein ion times-of-flight are used to determine mass to charge ratio and the sample source geometry indicates a functional relationship between initial ion position and initial ion velocity. Thus, the present invention may be used to improve the mass resolution of reflectron TOFMS systems, or systems employing non-linear magnetic or electric fields, for example. Further, applications such as DNA and protein sequencing, for example, can be enhanced using the techniques described herein.

These examples are illustrative of the spirit of the present invention and other variations of the disclosed embodiments are contemplated.

What is claimed is:

1. A method of spatial-velocity correlation focusing in a time-of-flight mass spectrometer to minimize the effects of distributions in initial ion position and initial ion velocity on the ion mass resolution of the spectrometer, said spectrometer having a first region for applying an ion accelerating field to accelerate ions of various mass to charge ratios generated from a sample source having an ion source geometry disposed within the first region and an ion detector remote from the first region, the method comprising the steps of:

(1) determining a first equation for the time-of-flight of the ions generated within the first region to the detector, said first equation being a function of a set of spectrometer variables including ion acceleration field strength, distance between the generated ions and the detector, ion mass, initial position of the ions generated within the first region, initial velocity of the ions generated within the first region and the time delay between the generation of ions within the first region and application of the acceleration field for accelerating the ions toward the detector;

(2) determining a second equation relating initial ion position within the first region to initial ion velocity within the first region, said second equation being a function of the ion source geometry;

(3) substituting said second equation into said first equation to form a third equation thereby eliminating one of the initial ion position and the initial ion velocity as a variable thereof;

(4) determining an optimum set of values for said spectrometer variable from said third equation so that the time spread in the time-of-flight of generated ions of any particular mass to charge ratio to the detector is minimized; and (5) accelerating the ions generated within the first region toward the ion detector in accordance with said optimum set of values for said spectrometer variables;

wherein minimizing said time spread in the time-of-flight of the generated ions to the detector of any particular mass to charge ratio results in minimizing the effects of the initial ion position distribution and initial ion velocity distribution on the ion mass resolution of the spectrometer.

2. The method of claim 1 wherein step (4) includes the following steps:

(a) selecting initial values for said set of spectrometer variables;

(b) calculating an expected ion time-of-flight from said third equation over a predetermined range of the other of the initial ion position and the initial ion velocity;

(c) accelerating the ions generated within the first region toward the ion detector and observing the time speed in ion time-of-flight from the expected ion time-of-flight values calculated in step (b) thereat;

(d) choosing an optimum set of values for said set of spectrometer variables in accordance with the value of the other of the initial ion position and the initial ion velocity that produces the minimum time spread in step (c); and (e) performing steps (b)–(d) until the time spread in the time-of-flight of the generated ions of any particular mass to charge ratio is minimized.

3. The method of claim 2 wherein said distance between the generated ions and the detector is a fixed value.

4. The method of claim 1 wherein step (4) includes the following steps:

(a) determining the first and second derivatives of said third equation with respect to the other of the initial ion position and the initial ion velocity;

(b) selecting a value for said other of the initial ion position and the initial ion velocity from a predetermined range;

(c) setting said first and second derivatives of said third equation equal to zero and solving for any two of said set of spectrometer variables; and (d) numerically determining said optimum values for the remaining variables in said set of spectrometer variables.

5. The method of claim 4 wherein said any two of said set of spectrometer values include said acceleration field strength and said time delay.

6. The method of claim 1 wherein the spectrometer further has a second region disposed between the first region and the detector for further accelerating the ions, and a third region disposed between the second region and the detector for providing an acceleration free drift region, and wherein said first equation is further a function of the acceleration field strength of the second region and of the lengths of the first, second and third regions.

7. The method of claim 6 wherein the generated ions are accelerated in the first and second regions by appropriately oriented first and second electric fields respectively.

8. The method of claim 7 wherein the first electric field is established by first and second potentials established at opposite ends of the first region and said second electric field is established by said second potential and a third potential established at opposite ends of the second region.

9. The method of claim 8 wherein the third region is maintained at the third potential.

10. The method of claim 9 wherein a third electric field is established in a fourth region between the third region and the detector, and the third electric field is established by the third potential of said third region and a fourth potential established at the detector, and further wherein the acceleration field strength of said first equation is a function of said first, second, third and fourth potentials, and of the length of said fourth region.

11. The method of claim 10 wherein step (4) includes the following steps:

(a) selecting initial values for the first, second, third and fourth potentials and for the time delay;

(b) calculating an expected ion time-of-flight from said third equation over a predetermined range of the other of the initial ion position and the initial ion velocity;

(c) providing said first, second, third and fourth potentials to thereby accelerate the ions generated within the first region toward the ion detector and observing the time spread in ion time-of-flight from the expected ion time-of-flight values calculated in step (b) thereat;

(d) choosing optimum values for the first, second, third and fourth potentials and for the time delay in accordance with the value of the other of the initial ion position and the initial ion velocity that produces the minimum time spread in step (c); and (e) performing steps (b)–(d) until the time spread in the time-of-flight of the generated ions of any particular mass to charge ratio is minimized.

12. The method of claim 10 wherein step (4) includes the following steps:

(a) determining the first and second derivatives of said third equation with respect to the other of the initial ion position and the initial ion velocity;

(b) selecting a value for said other of the initial ion position and the initial ion velocity from a predetermined range;

(c) setting said first and second derivatives of said third equation equal to zero and solving for any two of the first, second, third and fourth voltages and the time delay;

(d) calculating an expected ion time-of-flight from said third equation over a predetermined range of the other of the initial ion position and the initial ion velocity;

(e) providing said first, second, third and fourth potentials to thereby accelerate the ions generated within the first region toward the ion detector and observing the time spread in ion time-of-flight from the expected ion time-of-flight values calculated in step (d) thereat;

(f) choosing optimum values for the first, second, third and fourth potentials and for the time delay in accordance with the value of the other of the initial ion position and the initial ion velocity that produces the minimum time spread in step (c); and (g) performing steps (b)–(f) until the time spread in the time-of-flight of the generated ions of any particular mass to charge ratio is minimized.

* * * * *

UNITED STATES PATENT AND TRADEMARK OFFICE

CERTIFICATE OF CORRECTION

PATENT NO. : 5,504,326

DATED : April 2, 1996

INVENTOR(S) : James P. Reilly et al.

It is certified that error appears in the above-indentified patent and that said Letters Patent is hereby corrected as shown below:

In col. 1, line 21, please change "(Ill)" to --(m)--.
In col. 2, line 29, please change "tile" to --the--.
In col. 2, line 33, please change "tile" to --the--.
In col. 3, line 40, please change "Reflector" to --Reflectron--.
In col. 4, line 49, please change "tile" to --the--.
In col. 4, line 59, please change "tile" to --the--.
In col. 4, line 61, please change "tile" to --the--.
In col. 5, line 13, please change "tile" to --the--.
In col. 5, line 14, please change "tile" to --the--.
In col. 5, line 25, please change "tile" to --the--.
In col. 6, line 46, please change "iS" to --is--.
In col. 7, line 13, please change "iS" to --is--.
In col. 7, line 45, please change "tile" to --the--.
In col. 7, line 55, please change "tile" to --the--.
In col. 9, line 59, please change "lave" to --have--.
In col. 12, equation 18, please change "f" to --f'--.
In col. 13, line 50, please insert --the-- before "initial".
In col. 18, line 21, please change "variable" to --variables--.

In col. 18, line 41, please change "speed" to --spread--.

Signed and Sealed this

Twenty-fourth Day of December, 1996

Bruce Lehman

*Attest:*

BRUCE LEHMAN

*Attesting Officer*

*Commissioner of Patents and Trademarks*